United States Patent [19]

Greenlee

[11] 4,189,001

[45] Feb. 19, 1980

[54] FRICTION SPRING AND SLIP RETAINER FOR A MECHANICAL SETTING TUBING ANCHOR

[75] Inventor: Donald R. Greenlee, Dallas, Tex.

[73] Assignee: Dresser Industries, Inc., Dallas, Tex.

[21] Appl. No.: 928,753

[22] Filed: Jul. 27, 1978

[51] Int. Cl.[2] ..... E21B 23/00

[52] U.S. Cl. ..... 166/216; 294/86.25

[58] Field of Search ..... 166/216, 206, 213, 217; 294/86.19, 86.24, 86.25

[56] References Cited

U.S. PATENT DOCUMENTS

| | | | |
|---|---|---|---|
| 1,608,828 | 11/1926 | Wright | 294/86.25 |
| 2,141,987 | 12/1938 | Jones | 294/86.19 |
| 2,656,890 | 10/1953 | Brandon | 106/241 |
| 3,643,737 | 2/1972 | Current | 166/216 |

*Primary Examiner*—William F. Pate, III

*Attorney, Agent, or Firm*—Richard M. Byron

[57] ABSTRACT

A mechanical tubing anchor has a plurality of slip elements mounted in an elongated casing and movable between an extended position and a retracted position. A plurality of friction springs are rigidly secured around an upper end portion of the tubing anchor casing and extend downwardly with the lower end portion of each friction spring resting on an associated slip element. The friction springs extend outward from the casing along their mid-portion to rub against the interior of a well bore and to be compressed in order to bias the slip elements toward their retracted position.

7 Claims, 3 Drawing Figures

FRICTION SPRING AND SLIP RETAINER FOR A MECHANICAL SETTING TUBING ANCHOR

TECHNICAL FIELD

This invention is related to friction spring assemblies and slip assemblies for mechanical type well tubing anchors. More particularly this invention is related to means with a mechanical tubing anchor to urge the slips thereof to their retracted position coupled with means to provide friction in the well bore.

BACKGROUND OF THE INVENTION

Mechanical tubing anchors are utilized in wells where rod pumping is done in order to secure the tubing in a fixed position within the casing of the well bore. These tubing anchors are provided with a plurality of leaf type springs in a spaced relation around the exterior thereof which bulge outward and provide friction or contact with the well casing. In these anchors, the slips are mounted such that they will slide on the exterior of a conical segment of the hanger body or some type of mandrel or portion of a mandrel depending upon the specific construction of the anchor. In normal operation of the well anchors, the slips move from a retracted position when the tool is run into the well, then to an extended position to grip the well casing. Upon release of the tool, the conical surfaces or the like are moved apart and the slips are free to move to the retracted position. The slips can be simply left free of all constraints so they can move to the retracted position on their own provided no foreign material has become lodged under the slips. In other constructions which utilize a separate slip element to grip the casing for upward motion and downward motion, short leaf type springs are secured to some supporting structure on the exterior of the anchor cage and attached to the slip element. These short leaf springs are parallel to the longitudinal axis of the tool and function only to urge the slip elements toward their retracted position.

In other prior art constructions, small sharply bent leaf springs are mounted inside the anchor cage to urge the slips to their retracted position. These springs can be prone to sometimes encounter fatigue failures due to flexing of sharply bent portions of the springs. Also assembly of the tool is difficult because the springs must be attached to the slips and then placed inside the tool and held in position while the mandrel is inserted.

SUMMARY OF THE INVENTION

In an embodiment, the friction spring slip retainer structure of this invention includes a plurality of friction springs mounted around the exterior of a mechanical setting type tubing anchor wherein the friction springs are secured to the anchor at their upper end, are spaced from the anchor through their mid-portion, and contact the slip elements at their lower end. The connection between the friction springs and the individual slip members is such that the slip is continually urged toward the retracted position and such that the friction springs can be displaced with their lower end portion moving longitudinally relative to the longitudinal axis of the tool.

One object of this invention is to provide a friction spring and slip structure for mechanical setting tubing anchors which overcomes the aforementioned disadvantages of the prior art devices.

Still, one other object of this invention is to provide a slip construction for a mechanical tubing anchor which will insure that the slip elements are urged toward the retracted position so they will be retracted when the anchor is released for removal from a well bore.

Still, another object of this invention is to provide a friction spring construction for a mechanical tubing anchor which will freely flex as the anchor is moved through the well bore and will provide a friction restraint for the tubing anchor as well as provide a dual purpose by urging the slip elements of the anchor toward their normally retracted position.

Various other objects, advantages, and features of this invention will become apparent to those skilled in the art from the following discussion, taken in conjunction with the accompanying drawings, in which:

Figure 1:
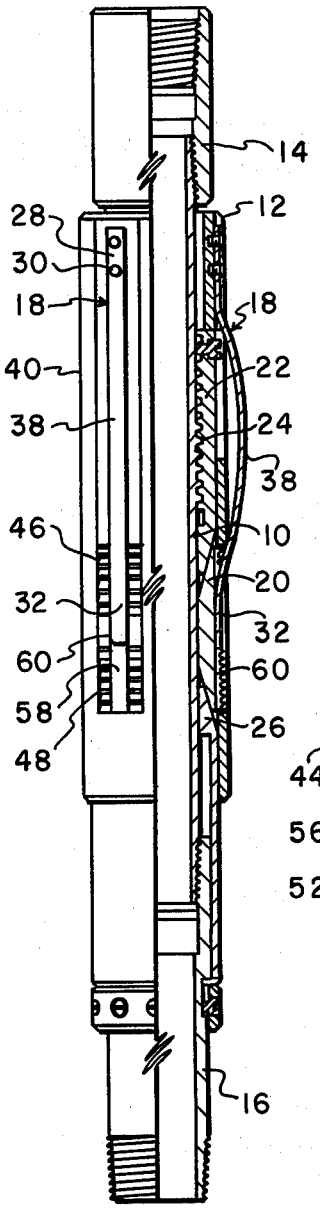
FIG. 1 is an elevational view of a mechanical tubing anchor employing this invention with portions cutaway, and having the slips in their retracted position.

The following is a discussion and description of preferred specific embodiments of the tubing anchor friction spring slip retainer of this invention, such description is made with reference to the drawings, whereupon the same reference numerals are used to indicate the same or similar parts and/or structure. It is to be understood that such discussion and description is not to unduly limit the scope of the invention.

DETAILED DESCRIPTION

Referring to FIG. 1, the tubing anchor is shown with the slips in their retracted position which is the position of the tubing anchor as it is run into or removed from a well. The tubing anchor includes a mandrel 10 extending the length of the tool with an anchor cage 12 around the mid-portion thereof. Mandrel 10 is secured to the tubing string by a top connection 14 and by a lower connection 16. Anchor cage 12 has a plurality of friction springs, indicated generally at 18, mounted in a spaced relation around the upper portion thereof. A plurality of slip elements or slips 20 are mounted in a spaced relation around the lower portion of anchor cage 12. The actuating mechanism for the tubing anchor includes an upper head 22 which is threaded on its interior and joined to a segment of mandrel teeth 24 around an outer portion of a mid-section of mandrel 10, and a lower head 24 which is secured to mandrel 12 at a lower portion thereof. The facing ends of upper head 22 and lower head 26 are generally frustoconically shaped so as to contact similarly frustoconically shaped portions of the slip members. Rotation of mandrel 10 to the left (looking down from top connection 14) will displace upper head 22 in a downward direction or toward a stationary lower head 26 with the result being slip 20 is displaced radially outward from the longitudinal axis of the tubing anchor. Rotation of mandrel 10 in the opposite direction, to the right, moves upper head away from stationary lower head 26 thereby allowing the slip members to return to their original retracted position.

The friction springs are all constructed alike and have a shallow U-shape when installed on the tubing anchor and when seen from the side as shown in FIG. 1. The upper end portion of each spring 28 is provided with a pair of apertures therethrough for securing the friction spring to the anchor cage 12 by a pair of screws 30. Each friction spring 18 has a lower end portion which rests on an associated slip element. The inner side surface 36 of spring lower end portion 32 is curved and shaped to a resting surface on the associated slip element 20 in order that an end portion of the spring rest in flush surface to surface contact with the slip element. The mid-portion 38 of each friction spring is curved such that it is spaced from the anchor cage exterior surface 40 a significant distance regardless of whether the slips are extended or retracted.

Figure 2:
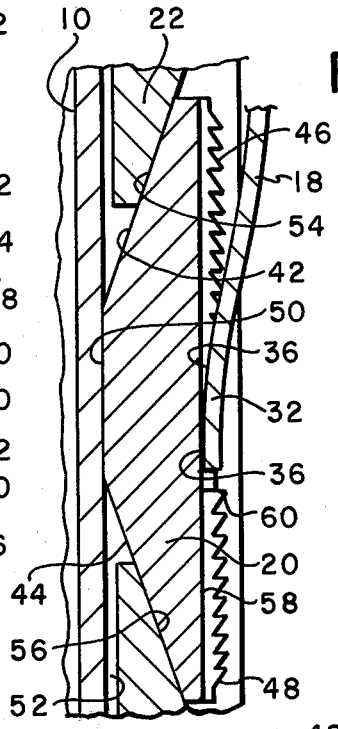
FIG. 2 is an enlarged cross-sectional view of one embodiment of the friction spring and slip element of this invention shown with the associated surrounding structure of the tubing anchor wherein the slip is positioned in the retracted position as shown in FIG. 1.

Referring to FIGS. 1 and 2, the plurality of slip elements are all constructed in a similar fashion including a back face with opposed inclined surfaces 42 and 44 and a front face with opposingly oriented teeth 46 and 48 on opposite end portions of the exterior thereof. Because teeth 46 and 48 are oriented in this manner, a single group of identical slips function simultaneously to hold the tubing anchor in place in opposition to forces from above and below. The inner or back face of each slip element has a flat surface 50 which rests on the exterior surface 52 of mandrel 10 when the slip is in the retracted position as shown in FIG. 2. Each slip back face inclined surface 42 lies adjacent to upper head frustoconical surface 54. On the opposite end of slip 20, lower head frustoconically shaped surface 56 which lies adjacent to slip inclined surface 44. When the tubing anchor is set, upper head 22 moves downward or toward lower head 26 which is stationary and this causes slip member 20 to be urged outward to the extended position with teeth 46 and 48 engaged in the interior surface of the well casing.

The outer or front face of each slip member is constructed similarly with oppositely directed groups of teeth 46 and 48 arranged in rows along the elongated edges of the individual slip member. An elongated recess 58 runs longitudinally the length of slip outer face between the rows of teeth and at a greater depth than the teeth. A resting surface 60 in a mid-portion of elongated recess 58 receives the friction spring lower end portion 32. Resting surface 60 provides a relatively smooth surface for spring inner surface 36 to contact and slide as the slip is moved between extended and retracted positions and as the friction spring is flexed as the tubing anchor moves through the well bore.

As the tubing anchor is run into a well bore, friction spring 18 rubs against the interior of the casing and this causes the spring to flex which in turn will displace spring lower end 32 portion longitudinally up and down in sliding motion on the associated slip. Because spring lower end portion 32 resides in recess 58 through the slip and is held in place by the spring force, it retains the associated slip without becoming displaced from the recess. This construction insures that the slip element will not inadvertently engage the well casing and will remain in the retracted position until it is required to be extended in the tubing anchor set.

When the tubing anchor is set, slip element 20 is spaced from mandrel 10. In this position, slip element 20 is supported on upper and lower frustoconically shaped head surfaces 54 and 56. When the tubing anchor is released, upper and lower heads 22 and 26 move apart to the spaced relation shown in FIG. 2 which allows slip 20 to move toward mandrel 10 thereby releasing the teeth and freeing the tubing anchor for removal from the well. In the prior art constructions, a slip retracting spring failure at this time would cause the slips to hand or be stuck in the event of accumulated foreign material such as sand, paraffin, and the like between the slip and the mandrel. However, in this construction, the slips are continually biased to the retracted position; therefore, problems with sticking and hanging of the slips are avoided and a positive retraction is assured.

An additional point worthwhile of noting is that due to the shallow curvature of friction springs 18, the curved segments thereof adjacent to upper and lower ends 28 and 32 are not subjected to exceeding large stresses during flexing of the springs and motion of the slips. Therefore, the springs can be expected to function for a substantially extended period of time without fatiguing these sections of the friction springs sufficiently to induce cracking or other fatigue associated failures. This feature is an important improvement over the prior art constuctions which utilize relatively short springs which are substantially and often sharply bent in order to retract the slip elements.

Figure 3:
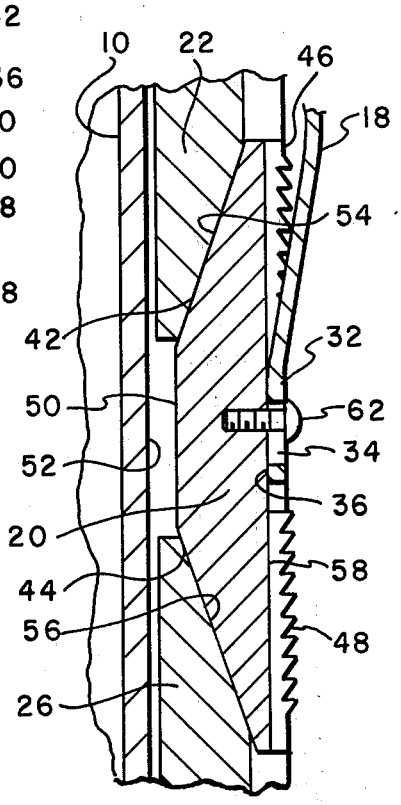
FIG. 3 is an enlarged cross-sectional view of another embodiment of the friction spring and slip structure showing a slip element and associated surrounding portions of the tubing anchor wherein the slip is shown in the extended position.

Referring to FIG. 3, such shows another embodiment of the slip and spring construction of this invention wherein friction spring 18 is secured to slip 20 by a fastener 62 which extends through a slot 34 in the spring. Fastener 62 is threadedly mounted with the slip in recess 58. Fastener 62 has a relatively broad head so that it will span slot 34 and retain friction spring 18 in a securely connected relation through all normal motions of the spring and the slip. Slot 34 is elongated relative to the elongated longitudinal direction of friction spring 18 and centrally located relative to the width of the spring.

Slot 34 and fastener 62 will allow substantially restricted motion of spring lower end 32 on slip 20 and will not restrict the flexing motion of the spring. Because the lower end of friction spring 18 rests on slip element 20, this continually urges the slip element toward the retracted position. This construction insures that the slip element and the friction spring will be positively connected during use of the tool as well as transport or storage between uses.

The friction spring slip retainer of this invention overcomes disadvantages of the prior art devices and provides a tubing hanger construction which utilizes the friction springs of the tubing anchor to urge the slip elements of the hanger toward the retracted position in a unique combination which insures that the slip elements are urged toward the retracted position while the tool is run into the well bore and when the tool is released for removal from the well. This construction can be incorporated in tubing anchor designs which are set as shown with the threaded members of those which are set by using slots and other latching mechanisms without departing from the scope of the invention.

The embodiments of the invention in which an exclusive property or privilege is claimed are defined as follows:

1. A slip retaining means for a retrievable mechanical setting tubing anchor, comprising:

(a) a plurality of slip elements mounted around a lower portion of the tubing anchor each having separate gripping elements to secure the tubing anchor within a casing against vertically up and down motion, each of said slip elements being movable between an extended position and a retracted position and said slip elements each having an elongated recess extending longitudinally across the gripping face thereof and residing in a substantially parallel relationship to the longitudinal axis of said tubing anchor;

(b) a plurality of friction springs having an upper end portion rigidly secured at an upper end portion of said tubing hanger and extending downward with the lower end portion of each spring contacting an associated slip element in the elongated recess thereof and wherein said friction springs each have a radially outwardly extending mid-portion to in use rub on the interior wall of a casing in which said tubing hanger is located in order to create frictional resistance to motion of the tubing hanger within the casing and to continually bias said friction springs to urge the associated slip elements toward said retracted position thereby insuring motion of the slip elements to said retracted position when said tubing hanger is released for removal from a well; and (c) said slip elements each have a friction spring resting area on a mid-portion of said elongated recess with a fastener extending through said friction spring and secured in said slip element at said resting area to loosely connect said slip element to said spring such that said slip element can move between the retracted and extended positions and said springs can move longitudinally relative to said anchor cage as said springs flex while said tubing anchor is in use.

2. In a mechanical setting retrievable tubing anchor having an anchor cage with a plurality of radially outwardly displaceable slip elements mounted in a spaced relation therearound and displaceable between a retracted position and an extended position, an improvement comprising a means to urge the slip elements toward the retracted position to insure their retraction upon release of the tubing hanger for removal from a well, comprising:

(a) a plurality of springs rigidly mounted in a spaced relation around an upper end portion of said anchor cage, extending downward therefrom and engaged with an associated slip element;

(b) said springs being elongated and having a curved mid-portion spaced from said anchor cage such that the exterior of said mid-portion will contact the interior of a well casing when said tubing hanger is placed therein, said springs being compressed sufficiently to urge said slip elements toward said retracted position; and (c) said slip elements each have means to retain an associated spring thereon and compensate for flexing motion of said spring and motion of said slip element between said retracted and extended position.

3. The means to urge the slip elements of claim 2, wherein said springs are each an elongated single leaf type spring formed in a shallow U-shape with outwardly oppositely extending ends with one end being rigidly secured to the anchor cage and the other end loosely coupled to said slip element.

4. The means to urge the slip element of claim 2, wherein said means to retain said spring has a recess extending longitudinally through a mid-portion of the exterior of said slip element wherein said recess is of a sufficient depth to substantially enclose an end portion of an associated spring and retain it therein.

5. The means to urge the slip elements of claim 2, wherein said means to retain said spring has an aperture through said spring, a spring resting area on said slip element, and a fastener extending from said slip element and through said slotted aperture to loosely secure said spring and said fastener such that said spring is sufficiently loosely joined to said associated slip element such that the primary force of said spring is exerted to urge said slip element toward said retracted position and the portion of said spring which is resting on said slip element can move laterally and longitudinally relative to said slip element.

6. In a mechanical setting retrievable tubing anchor having an anchor cage with a plurality of radially outwardly displaceable slip elements mounted in a spaced relation therearound and displaceable between a retracted position and an extended position, an improvement comprising a means to urge the slip elements toward the retracted position to insure their retraction upon release of the tubing hanger for removal from a well, comprising:

(a) a plurality of springs rigidly mounted in a spaced relation around an upper end portion of said anchor cage, extending downward therefrom and having a lower end portion engaged with an associated slip element;

(b) said springs being elongated and having a curved mid-portion spaced from said anchor cage such that the exterior of said mid-portion will contact the interior of a well casing when said tubing hanger is placed therein, said springs being compressed sufficiently to urge said slip elements toward said retracted position said springs each having an aperture through said lower end portion at a location overlying and in contact with the associated slip; and (c) said slip elements each have means to retain an associated spring thereon and compensate for flexing motion of said spring and motion of said slip element between said retracted and extended positions including a fastener rigidly secured to said slip element and extending through said aperture of the associated spring.

7. The slip retaining means of claim 6 wherein:

(a) said slip elements each have an elongated recess portion residing in a substantially parallel relationship to the longitudinal axis of said tubing anchor wherein said one of said friction springs has said lower end portion contacting said outside surface;

(b) said slip elements each have said fastener extending from said elongated recess and through the aperture of the associated spring; and (c) said aperture in each of said springs being a slot which is elongated in the longitudinal direction of said spring.

* * * * *